US008528607B2

(12) United States Patent
Wagner

(10) Patent No.: US 8,528,607 B2
(45) Date of Patent: Sep. 10, 2013

(54) LIQUID BEVERAGE FILLING MACHINE FOR FILLING CONTAINERS, SUCH AS BOTTLES OR CANS, WITH A LIQUID BEVERAGE, AND A METHOD OF FILLING CONTAINERS WITH A LIQUID BEVERAGE, IN WHICH THE FLOW OF LIQUID IS MONITORED AND MEASURED

(75) Inventor: Felix Wagner, Nürnberg (DE)

(73) Assignee: KHS GmbH, Dortmund (DE)

( * ) Notice: Subject to any disclaimer, the term of this patent is extended or adjusted under 35 U.S.C. 154(b) by 608 days.

(21) Appl. No.: 12/791,431

(22) Filed: Jun. 1, 2010

(65) Prior Publication Data

US 2010/0300577 A1 Dec. 2, 2010

Related U.S. Application Data

(63) Continuation-in-part of application No. PCT/EP2008/008808, filed on Oct. 17, 2008.

(30) Foreign Application Priority Data

Nov. 30, 2007 (DE) ..... 10 2007 058 047

(51) Int. Cl.
*B65B 1/30* (2006.01)

(52) U.S. Cl.
USPC ..... 141/94; 141/290; 222/424; 222/318; 366/136; 366/159.1

(58) Field of Classification Search
USPC ..... 141/94, 290; 137/563; 222/424, 222/318; 366/136, 137, 159.1
See application file for complete search history.

(56) References Cited

U.S. PATENT DOCUMENTS

| | | | | |
|---|---|---|---|---|
| 5,823,388 | A * | 10/1998 | Green | 222/1 |
| 5,944,071 | A | 8/1999 | Tietz et al. | |
| 6,019,116 | A * | 2/2000 | Schell | 137/14 |
| 6,463,964 | B2 | 10/2002 | Cluesserath | |
| 7,694,858 | B2 | 4/2010 | Takeda | |
| 8,231,064 | B2 * | 7/2012 | Lum et al. | 236/12.13 |
| 2006/0191954 | A1 * | 8/2006 | Lowe | 222/52 |
| 2007/0113919 | A1 | 5/2007 | Gruson | |

FOREIGN PATENT DOCUMENTS

| | | | |
|---|---|---|---|
| DE | 24 35 011 | C2 | 2/1976 |
| DE | 39 30 593 | A1 | 3/1991 |
| DE | 201 05 716 | U1 | 5/2002 |
| DE | 100 28 676 | A1 | 6/2002 |
| EP | 1598 308 | A1 | 11/2005 |

* cited by examiner

*Primary Examiner* — Jason K Niesz
(74) *Attorney, Agent, or Firm* — Nils H. Ljungman & Associates

(57) ABSTRACT

Liquid beverage filling machine for filling containers, such as bottles or cans, with a liquid beverage, and a method of filling containers with a liquid beverage, in which the flow of liquid is monitored and measured. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 2 Drawing Sheets

LIQUID BEVERAGE FILLING MACHINE FOR FILLING CONTAINERS, SUCH AS BOTTLES OR CANS, WITH A LIQUID BEVERAGE, AND A METHOD OF FILLING CONTAINERS WITH A LIQUID BEVERAGE, IN WHICH THE FLOW OF LIQUID IS MONITORED AND MEASURED

CONTINUING APPLICATION DATA

This application is a Continuation-In-Part application of International Patent Application No. PCT/EP2008/008808, filed on Oct. 17, 2008, which claims priority from Federal Republic of Germany Patent Application No. 10 2007 058 047.0, filed on Nov. 30, 2007. International Patent Application No. PCT/EP2008/008808 was pending as of the filing date of this application. The United States was an elected state in International Patent Application No. PCT/EP2008/008808.

BACKGROUND

1. Technical Field

The present application relates to a device and a method for filling liquids, in at least one possible embodiment carbonated beverages into bottles, cans or similar containers, the device having at least one filling tank and filler elements connected thereto, and having a least one measuring device for the quantitative and/or qualitative analysis of the liquid.

2. Background Information

Background information is for informational purposes only and does not necessarily admit that subsequently mentioned information and publications are prior art.

Filling machines for filling liquids may come in many forms. This applies to those filling machines that are used for the filling of beverages.

Usually the procedure for the filling of carbonated beverages is to mix water with at least one further constituent (generally speaking a beverage syrup) in a mixing container that is connected upstream of the filler tank. The mixture of water and the at least one further constituent is then carbonated or is carbonated at the same time or essentially the same time in a so-called carbonation device. The carbonation device may be a component of the mixing device or of the mixing container or may also be a separate device.

As the quality of the beverage and generally speaking of the liquid in the example described depends enormously on the carbonic acid or carbon dioxide content, the proportion of additional constituents (beverage syrup) and supplementary features, the aforementioned measuring device for the quantitative and/or qualitative analysis of the liquid may be utilized. This measuring device is in the form of a volume and quantity measuring device. Normally the measuring device in question is situated in a supply line for the filler tank or is positioned in a ring channel to the individual filler elements. This arrangement produces problems in the event of a changeover to the bottling of another liquid, because the amount of the old beverage that is still in the filler tank must either be disposed of or modified to achieve the desired quantity or quality of the new beverage, which is not always possible. The present application wishes to find a remedy to this problem.

OBJECT OR OBJECTS

An object of the present application is to provide a method and a device for filling liquids where a continuous quantity and quality analysis of the liquid is promoted.

SUMMARY

The present application proposes to achieve this object with a generic device for filling liquids in that the measuring device is positioned in a return circuit or return line for the guiding of the liquid in a circulating manner through the filler tank.

Within the scope of the present application, therefore, the liquid to be filled is guided in a circulating manner through the filler tank, that is to say within the closed loop. According to the present application, the measuring device is looped into the return circuit or into a return line desired for this, the measuring device being used in an unvaried manner for the quantitative and/or qualitative analysis of the liquid. In this case, the design can be such that the liquid to be filled is guided in a circulating manner through the filler tank and consequently through the return line for example up until, with the aid of the measuring device, the desired quantity/quality is present. Then the actual filling procedure will be set in motion by means of the filler elements and containers connected to the filler elements in each case. This method of operation may be beneficial in at least one possible embodiment of the present application, when there is a change in the liquid to be processed or a change in such a beverage.

In order to achieve this in detail, the measuring device is in the form of a concentration and/or temperature and/or density and/or conductivity measuring device or the like. Within the setup of the concentration measuring, it can be ascertained, for example, whether the concentration of the additional constituents (beverage syrup) in the water is sufficient. Depending on the measured values obtained from the measuring device, a control unit that processes the measured values can provide for corresponding counter measures, for example mixing the constituents or water in the mixing device or the mixing container that is normally connected upstream of the described device for filling. In at least one possible embodiment of the present application, the control unit impinges upon or activates or actuates a corresponding metering device (in or at a metering line) in dependence on the measured values of the measuring device, in terms of a closed loop. This means that the quality predetermined in the control unit can be set in terms of a desired/actual value comparison. The same is also true, in principle, for the quality of the liquid to be filled, i.e. ultimately the quality of the content of the filling tank.

The described concentration measuring is not limited just to additional constituents (beverage syrup) that are mixed in the majority of cases with water in the case of a carbonated beverage, but also includes the $CO_2$ content of the beverage. That means that the carbon dioxide content can be detected in a comparable manner with the assistance of the measuring device and, with recourse to the control unit and to an (additional) metering device, can be predetermined and adjusted in terms of a closed loop with consideration to a desired/actual value comparison.

Measures where the measuring device is in the form of a density measuring device lead in the same direction. In this case too, conclusions as to the quality of the liquid can be drawn from the measured values, respectively density values resulting herefrom and corresponding counter measures can be taken as described. Ultimately the measuring device can also be in the form of a conductivity measuring device and in this way allows conclusions to be drawn on, for example, the turbidity of the liquid or of the beverage. Corresponding counter measures introduced by the control unit can comprise, for example, connecting or disconnecting a filter stage, guiding the beverage through a filter tank again, etc.

If the measuring device is in the form of a temperature measuring device, the temperature of the liquid to be filled can easily be influenced in that this temperature is tempered in a corresponding manner prior to the filling procedure. For this purpose, at least one heat exchanger may be positioned in the return circuit or return line for the guiding of the liquid in a circulating manner. The circulating liquid can be tempered with the assistance of the heat exchanger, in principle cooled down or heated up. This occurs, in its turn, in terms of a closed loop in such a manner that the control unit actuates the heat exchanger for influencing the temperature of the liquid corresponding to the parameters of the measuring device that is in the form of a temperature measuring device. The present application also includes a measuring device or measuring devices that detect all or substantially all the aforementioned variables and transmit them to the control unit for the desired/actual value comparison represented.

Over and above this, it has proved of value when the return circuit or return line and a supply line to the respective filler element are connected to a common junction. This essentially ensures that the entire liquid volume is monitored or can be monitored with regard to its quantity and/or quality. For, according to the present application, the liquid in the filling tank, as well as the liquid that is situated in a supply line to the respective filler element, is included in the measurements taken by means of the measuring device. The described development provides for this.

The return circuit or return line mentioned extends from the described junction as far as a supply line. That means that the return line normally opens out into a supply line of the mixing container that is connected upstream of the filler tank. The already mixed beverage is supplied to the mixing container generally speaking via the supply line or the described mixing components (water and beverage syrup in the majority of cases) are introduced into the mixing container via the supply line.

Over and above this, the design is such in the majority of cases that a metering line opens out into the return line itself. The liquid can be adapted with regard to its quantity and quality in dependence on the measured values of the measuring device via the metering line or the metering device interacting therewith. For the metering device or the metering line is impinged upon or activated or actuated in a corresponding manner by the control unit.

This is effected, as described, in terms of a closed loop. This means that, with the assistance of the control unit, the measuring device and the metering line or respectively the metering device provided at this location, the liquid is adjusted in terms of a closed loop with regard to qualitative and quantitative parameters. These parameters can be saved in the control unit for example from outside or can be predetermined by the control unit. In this case, it is altogether possible to monitor the individual quality parameters collectively online. The qualitative and quantitative parameters can also be stored and checked online.

Described here are a device and an associated method, in at least one possible embodiment of the present application in conjunction or in connection with the filling of liquids, and in this case, in at least one possible embodiment, with the filling of carbonated beverages into bottles, cans or similar containers. The present application namely makes it possible for the quality and where applicable the quantity of the liquid to be filled to be checked along its entire path up to the filler elements. This is extraordinarily important where there is a change in the liquid or the beverage to be filled.

In order not to generate any defective batches or to waste liquid in this case, the liquid is guided in a circulating manner, that means in the closed loop, through the filling tank. This can be performed in the case of a change in liquid or in beverage just until the desired quality and/or quantity is present. The actual filling procedure is not started until that point. The quality check is also effected after this in an unvaried, continuous manner because the return circuit or return line provided for this purpose with the measuring device or the plurality of measuring devices positioned therein is responsible for essentially ensuring that the liquid situated in the filler tank at any one time is monitored in a permanent, substantially permanent, or essentially permanent manner and also can be monitored.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present application is described in more detail below by way of drawings representing possible embodiments of the present application.

DESCRIPTION OF EMBODIMENT OR EMBODIMENTS

Figure 1:
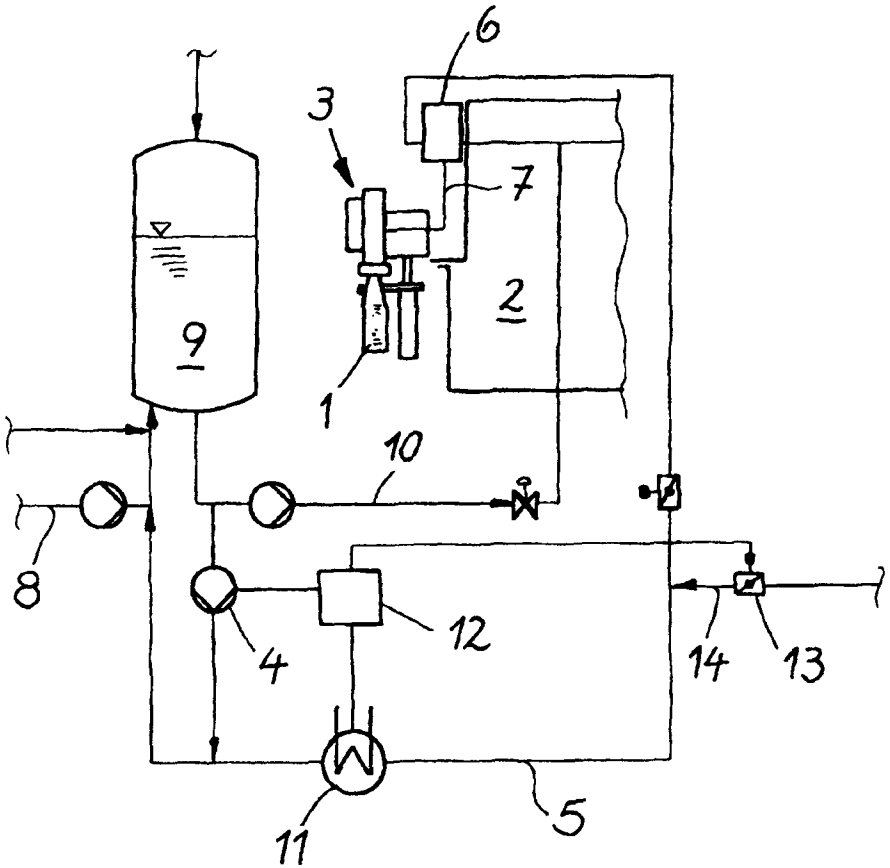
FIG. 1 shows a device for filling liquids, in one embodiment for filling a carbonated beverage into a simply illustrated bottle 1.

A can or another container can also be filled with the liquid in place of the bottle 1. The present application is primarily concerned with a filler tank 2, which is in the form of a ring tank as is generally the case.

Containers which may possibly be utilized in at least one possible embodiment of the present application may possibly be cans, bottles, kegs, barrels, or demijohns.

A plurality of filler elements 3 are connected to the filler tank 2 in a circular manner, the filler elements 3 being responsible ultimately for providing the filling of the liquid into the bottle 1 in the example. The filler tank 2 and the filler elements 3 may be constructed in such a manner as described above. The filler tank 2 or respectively the filler elements 3 are components of a rotor, which circulates about a vertical, substantially vertical, or essentially vertical machine axis and includes the various filler elements 3 at regular or essentially regular angular spacings. In order to fill the respective bottles, the bottles are applied to the filler elements 3 by means of a vertical, substantially vertical, or essentially vertical stroke movement and are lowered again after the filling procedure.

In accordance with at least one possible embodiment of the present application, the filler elements 3 are configured to fill the bottles 1 with a liquid beverage. A plurality of filler elements 3 may be disposed on a rotor configured to rotate the filler elements 3 about the outside of the filler tank 2. The rotor rotate about a vertical, substantially vertical, or essentially vertical machine axis which machine axis may be parallel, substantially parallel, or essentially parallel the longitudinal axis of the filler tank 2. In at least one possible embodiment, the bottles 1 are moved along a vertical, substantially vertical, or essentially vertical axis to come into contact with and to be filled with liquid beverage at the filling elements 3. After the filling process, the bottles 1 are moved from the filling elements 3 along a vertical, substantially vertical, or essentially vertical axis.

In at least one possible embodiment of the present application, the filler tank 2 and the filler elements 3 may comprise a single rotor. In such an embodiment, the filler tank 2 and the filler elements 3 are configured to rotate about an essentially identical vertical, substantially vertical, or essentially vertical machine axis.

At least one measuring device 4 is also counted as one of the essential elements, the measuring device providing a quantitative and/or qualitative analysis of the liquid to be filled or of the carbonated beverage in the example. Using the measuring device 4, among other things the sugar content or the turbidity can be determined by means of conductivity measurements, the content of carbon dioxide or of syrup can be determined by means of concentration measurements, the temperature of the liquid can be determined by means of temperature measurements, etc., as has already been described in an introductory manner. Of significance is the circumstance where the aforementioned measuring device 4 or the plurality of measuring devices 4 are positioned in a return circuit or return line 5, which guides the liquid to be filled in a circulating manner, that is in the closed loop, through the filler tank 2.

The return circuit or return line 5 initially passes from a common junction 6 with a supply line 7 to the respective filler element 3. From the junction 6 the return line 5 passes as far as a supply line 8 for a mixing container 9, which is connected upstream of the filler tank 2. From there, the liquid is guided via the mixing container 9 and a connecting line 10 to the filler tank 2 and back into the filler tank 2. This means that the liquid is guided in a circulating manner through the filler tank 2, that is to say within the closed loop.

In accordance with at least one possible embodiment of the present application, the filler tank 2, the common junction 6, the return line 5, the mixing container 9, and the connecting line 10 comprise, at least for some period of time, a closed-loop system. The closed-loop system is configured to move a liquid beverage in a closed loop, at least for some period of time. The mixing container 9 is configured to contain a liquid beverage to be mixed and/or conditioned before the liquid beverage is filled into bottles 1. The mixing container 9 is connected to a connecting line 10. The connecting line 10 is configured to move a liquid beverage from the mixing container 9 into the filler tank 2. In at least one possible embodiment, a common junction 6 is configured to connect to the filler tank 2 and also to the filler element 3. The common junction 6 is configured to connect to the filler element 3 via a supply line 7. The supply line 7 is configured to direct liquid beverage into a filler element 3 upon the filler element 3 filling a bottle 1. The common junction 6 may also be configured to connect to the return line or return circuit 5. The return line 5 is configured to move liquid beverage to a supply line 8. The supply line 8 is configured to move liquid beverage into the mixing container 9.

In accordance with at least one possible embodiment of the present application, the return line 5 comprises at least one measuring device 4. The measuring device 4 is configured to measure the quantity and/or quality of the liquid beverage as the liquid beverage moves through the return line 5. For example, the measuring device 4 may be configured to measure the sugar content, the carbon dioxide concentration, the temperature, the conductivity, the density and/or the concentration level of the liquid as the liquid beverage moves through the return line 5.

In order to influence the temperature of the liquid in the return line 5, at least one heat exchanger 11 is positioned in the return line 5. The heat exchanger 11 is connected to a common control unit 12 just as the measuring device 4. A metering device 13 is also connected to the control unit 12, the metering device being positioned in a metering line 14. The metering line 14 opens up into the return circuit or return line 5 in order to adjust the liquid to be filled in dependence on the measured values of the measuring device 4. This applies in at least one possible embodiment of the present application, with regard to its quality and quantity. Corresponding parameters are converted in this case by the control unit 12.

In other words, in accordance with at least one possible embodiment of the present application, the control unit 12 is configured to control the measuring device 4, the metering device 13, and/or the heat exchanger 11. The control unit 12 is configured to analyze measurements of liquid beverage quality and/or quantity measured by the measuring device 4. The control unit 12 may also be configured to control, activate, and/or actuate the heat exchanger 11, the metering device 13, and/or the measuring device 4. In at least one possible embodiment, the control unit 12—is configured to be programmed with one or more predetermined, desired measurements of quantity and/or quality of the liquid beverage. The control unit 12 is configured to compare one or more predetermined, desired quantity and/or quality measurements of the liquid beverage to the actual quantity and/or quality measurements measured by the measuring device 4. The control unit 12 is configured to control, activate, and/or actuate the appropriate connected device or devices in order to compensate for differences between one or more predetermined, desired quantity and/or quality measurements and the actual quantity and/or quality measurements of the liquid beverage in the return line 5.

The liquid is adjusted with the aid of the control unit 12, the measuring device 4 and the metering line 14 or respectively the metering device 13 in terms of a closed loop with regard to qualitative and quantitative parameters. This is referred to in the example of the $CO_2$ content.

If the measuring device 4 determines that the $CO_2$ content in the liquid to be filled is too low, the corresponding measured values transmitted to the control unit 12 result in the control unit 12 correspondingly impinging on or activating or actuating the metering device 13 in such a manner that the return line 5 or the liquid guided therein is supplied with additional carbon dioxide by means of the metering device 13 and the metering line 14. An additional carbonation procedure therefore takes place.

For example, in at least one possible embodiment of the present application, the measuring device 4 may be configured to measure the concentration of $CO_2$ in the liquid beverage in the return line 5. In such an embodiment, the control unit 12 is configured to analyze the $CO_2$ concentration measurements measured by the measuring device 4. The control unit 12 is programmed with desired $CO_2$ concentration parameters of the liquid beverage. The actual $CO_2$ concentration measurement of the liquid beverage measured by the measuring device 4 may be less than the desired $CO_2$ concentration parameters programmed in the control unit 12. In this instance, the control unit 12 is configured to compare the difference between the predetermined desired $CO_2$ concentration parameters and the actual measured $CO_2$ concentration of the liquid beverage measured by the measuring device 4. In at least one possible embodiment, the control unit 12 is configured to activate or actuate the metering device 13. The metering device 13, when activated or actuated, is configured to add carbon dioxide into the metering line 14. The metering line 14 is configured to be connected to the return line 5. The metering line 14, in at least one possible embodiment of the present application, is configured to move $CO_2$ into the return line 5 upon the liquid beverage moving through the closed-loop system.

This procedure is continued until the control unit 12 stops the extra addition within the framework of a continuous desired/actual value comparison. This means that the quality of the liquid is adjusted, in terms of a closed loop, with regard to the feature of carbon dioxide concentration. As the liquid overall is guided in a circulating manner through the filler tank 2 and at the same time or essentially the same time is analyzed by the measuring device 4, this essentially ensures that all, virtually all, substantially all, or essentially all the liquid situated in the filler tank 2 and ultimately also the liquid in the supply line 7 to the individual filler elements 3 is provided with the desired, predetermined $CO_2$ content in the example.

In accordance with at least one possible embodiment of the present application, the closed-loop system may permit the liquid beverage to move through the closed-loop system until the measuring device 4 measures a $CO_2$ concentration in the liquid beverage which is within the predetermined, desired parameters programmed in the control unit 12. With the filler tank 2 as a component of the closed-loop system, liquid beverage inside the filler tank 2 is also moved through the closed-loop system. Therefore, any liquid beverage in the filler tank 2 may receive added $CO_2$ via the metering line 14. Any liquid beverage in the filler tank 2 may also be measured by the measuring device 4 upon the liquid beverage moving through the return line 5. Therefore, the liquid beverage in the filler tank 2 is included in the addition of $CO_2$ by the metering device 13 via the metering line 14.

The liquid is therefore monitored in terms of a closed loop with regard to quality and/or quantity. In this case, both the quality and the quantity can be evaluated online at the location of the device and/or remote from the device represented in the present application. This means that the entire device can be controlled remotely where desired. For in principle the control unit 12 can also be positioned at a remote location. In this case, the connection to the measuring device 4 and the metering device 13 in the example can be produced by means of any conceivable telecommunication connection, for example a telephone line, the Internet or also a wireless connection.

According to at least one possible embodiment of the present application, the measuring device 4 is disposed relatively closely but prior to the mixing container 9 at the return line 5. Because of the substantial size of high-speed, large-capacity beverage bottling machines, which can fill upwards of 100,000 bottles per hour, undesired changes in the characteristics of a beverage or other liquid may occur as the beverage travels through the lengthy return line. For example, the temperature of the beverage could rise or fall, or possibly the carbonation level could be lowered. By placing the measuring device 4 at or in the return line 5, such changes could be detected and corrective steps, such as the heating of the liquid by the heat exchanger 11 or the adding of carbon dioxide by the metering device 13, could be taken to adjust the characteristics of the liquid in the return line 5 back to a desired or predetermined state. In this possible embodiment, the undesired changes are detected as they are starting to develop but before the entire batch of liquid in the mixing container 9 and in the tank 2 has been affected by these changes. Consequently, the liquid in the mixing container 9 and the tank 2 can be monitored and maintained with the desired characteristics of temperature, carbonation level, etc. In addition, since changes to the characteristics of the liquid can occur as the liquid travels through the relatively lengthy return line 5 or path, at least the measuring device 4, and possibly the heat exchanger 11 and metering device 13, are placed as near the mixing container 9 as possible. In such an embodiment, the liquid has a relatively short distance to travel before it reaches the mixing container 9. Consequently, the opportunity for the characteristics of the liquid to change after the liquid has been analyzed by the measuring device 4 and adjusted by either the heat exchanger 11 and/or the metering device 13, but before the adjusted liquid reaches the mixing container 9, is minimized as the distance of travel is minimized. In other words, the shorter the distance the liquid has to travel, the less chance there is that the characteristics of the liquid will be undergo alteration.

In addition, by using at least one measuring device 4 on the return line 5, rather than a plurality of individual measuring devices, one for each filling element 3, costs for manufacturing the filling machine can be reduced. In other words, it would be much less expensive to equip the filling machine with a single measuring device 4 on a single, common return line 5, rather than equip the filling machine with many measuring devices 4 positioned such that there is one measuring device 4 per each filling element 3.

In another possible embodiment, the control unit 12 can also be used to control the flow of other liquid beverage components, such as beverage syrup, based on information received from the measuring device 4. In yet another possible embodiment, an additional or bypass line can connect the connecting line 10 and the return line 5 to permit some of the liquid which has left the mixing container to circulate past the measuring device 4 without having to first travel through the tank 2 and the return line 5. This bypass line would allow the measuring device 4 to quickly measure the qualitative or quantitative characteristics of the liquid flowing out of the mixing container 9.

Figure 2:
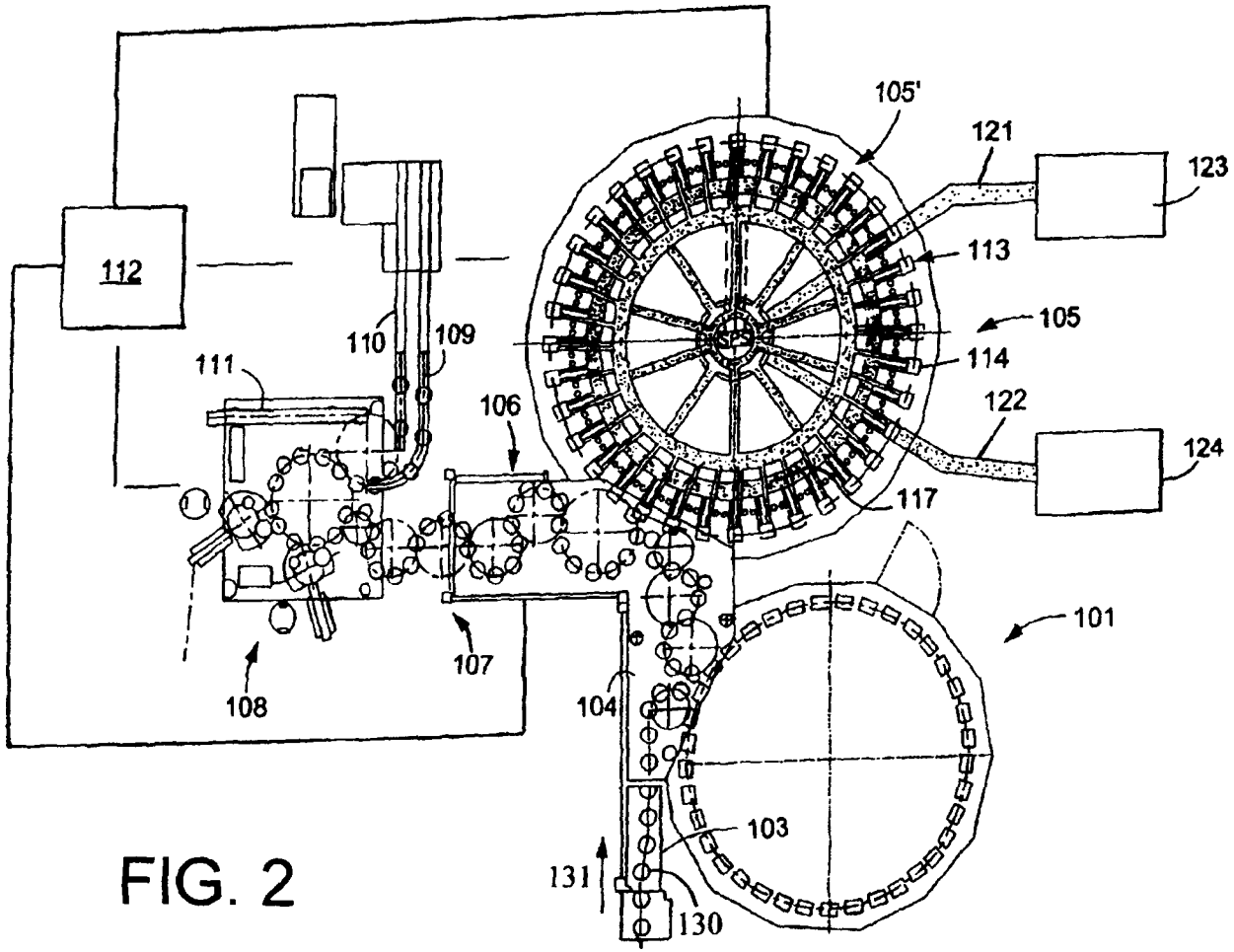
FIG. 2 shows schematically the main components of one possible embodiment example of a system for filling containers, in which system or plant could possibly be utilized at least one aspect, or several aspects, of the embodiments disclosed herein.

FIG. 2 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 2 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 2, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

The present application relates to a method and a device for filling liquids, particularly carbonated beverages, into bottles 1, cans, or similar receptacles. To this end, at least one filling container 2 and filler elements 3 connected thereto are provided. In addition, at least one measurement device 4 is present for quantitative and/or qualitative analysis of the liquid. According to the present application, the above-mentioned measurement device 4 is disposed in a return line 5 for conducting the liquid through the filling container 2 in a circulating fashion.

One feature or aspect of an embodiment is believed at the time of the filing of this patent application to possibly reside broadly in a device for filling liquids, in at least one possible embodiment, carbonated beverages into bottles 1, cans or similar containers, said device having at least one filling tank 2 and filler elements 3 connected thereto, and having at least one measuring device 4 for the quantitative and/or qualitative analysis of the liquid, wherein the measuring device 4 is positioned in a return line 5 for the guiding of the liquid in a circulating manner through the filler tank 2.

Another feature or aspect of an embodiment is believed at the time of the filing of this patent application to possibly reside broadly in the device, wherein the measuring device 4 is in the form of a concentration and/or temperature and/or density and/or conductivity measuring device or the like.

Yet another feature or aspect of an embodiment is believed at the time of the filing of this patent application to possibly reside broadly in the device, wherein the return line 5 and a supply line 7 to the respective filler element 3 are connected to a common junction 6.

Still another feature or aspect of an embodiment is believed at the time of the filing of this patent application to possibly reside broadly in the device according to the present application, wherein the return line 5 opens out into a supply line 8 of a mixing container 9 that is connected upstream of the filler tank 2.

A further feature or aspect of an embodiment is believed at the time of the filing of this patent application to possibly reside broadly in the device according to the present application, wherein at least one heat exchanger 11 is positioned in the return line 5.

Another feature or aspect of an embodiment is believed at the time of the filing of this patent application to possibly reside broadly in the device according to the present application, wherein a metering line 14 opens out into the return line 5 in order, in dependence on measured values of the measuring device 4, to adapt the liquid with regard to its quantity and/or quality to parameters transmitted by a control unit 12.

Yet another feature or aspect of an embodiment is believed at the time of the filing of this patent application to possibly reside broadly in the device according to the present application, wherein, with regard to qualitative and quantitative parameters, the liquid is adjusted with the aid of the control unit 12, the measuring device 4 and the metering line 14 in terms of a closed loop.

Still another feature or aspect of an embodiment is believed at the time of the filing of this patent application to possibly reside broadly in a method for filling liquids, in at least one possible embodiment of the present application, carbonated beverages in bottles 1, cans or similar containers, in at least one possible embodiment, for accomplishment in a device according to the present application, the device having at least one filler tank 2 and filler elements 3 connected thereto, according to the method the liquid being analyzed in a quantitative and/or qualitative manner with the aid of a measuring device 4, wherein the liquid is guided in a circulating manner through the filler tank 2 and at the same time is analyzed by means of the measuring device 4.

A further feature or aspect of an embodiment is believed at the time of the filing of this patent application to possibly reside broadly in the method, wherein the liquid is monitored with regard to quality and/or quantity in terms of a closed loop.

Another feature or aspect of an embodiment is believed at the time of the filing of this patent application to possibly reside broadly in a method according to the present application, wherein the quality and/or quantity are monitored online.

One feature or aspect of an embodiment is believed at the time of the filing of this patent application to possibly reside broadly in a rotary beverage filling machine for filling beverage containers, such as bottles, cans, or other containers, with a carbonated liquid beverage, said beverage filling machine comprising: a rotor; a rotatable vertical machine column; said rotor being connected to said vertical machine column to permit rotation of said rotor about said vertical machine column; a plurality of beverage container filling elements being disposed on the periphery of said rotor; each of said plurality of beverage container filling elements comprising a container carrier being configured and disposed to receive and hold beverage containers to be filled; each of said plurality of beverage container filling elements being configured and disposed to dispense liquid beverage into beverage containers to be filled; at least one liquid tank being configured to hold a supply of liquid beverage; at least one supply line being configured and disposed to connect said at least one liquid tank to said beverage container filling elements; a mixing container being configured to mix components of a liquid beverage; a connecting line being configured and disposed to connect said mixing container to said at least one liquid tank to permit flow of liquid beverage from said mixing container to said at least one liquid tank; a return line being configured and disposed to connect said at least one liquid tank to said mixing container to permit flow of liquid beverage from said at least one liquid tank to said mixing container; at least one measuring device for the quantitative and/or qualitative analysis of the liquid beverage; said at least one measuring device being disposed at said return line to permit measurement of liquid beverage flowing through said return line from said at least one liquid tank; and said at least one measuring device is configured to measure at least one of: liquid beverage concentration, liquid beverage temperature, liquid beverage density, liquid beverage conductivity.

Another feature or aspect of an embodiment is believed at the time of the filing of this patent application to possibly reside broadly in a method of filling containers, such as bottles, cans, or similar containers with carbonated liquid beverage, said method comprising the steps of: circulating liquid beverage through a mixing container, a connecting line, at least one liquid tank, and a return line; filling beverage containers with liquid beverage; analyzing the liquid beverage flowing through said return line with a measuring device in a quantitative and/or qualitative manner by measuring at least one of: liquid beverage concentration, liquid beverage temperature, liquid beverage density, liquid beverage conductivity.

Yet another feature or aspect of an embodiment is believed at the time of the filing of this patent application to possibly reside broadly in the device according to the present application A rotary beverage filling machine for filling beverage containers, such as bottles, cans, or other containers, with a carbonated liquid beverage, said beverage filling machine comprising: a rotor; a rotatable vertical machine column; said rotor being connected to said vertical machine column to permit rotation of said rotor about said vertical machine column; a plurality of beverage container filling elements being disposed on the periphery of said rotor; each of said plurality of beverage container filling elements comprising a container carrier being configured and disposed to receive and hold beverage containers to be filled; each of said plurality of beverage container filling elements being configured and disposed to dispense liquid beverage into beverage containers to be filled; a liquid tank being configured to hold a supply of liquid beverage; a supply line arrangement being configured and disposed to connect said liquid tank to said beverage container filling elements; a mixing container being configured to mix components of a liquid beverage; a connecting line being configured and disposed to connect said mixing container to said liquid tank to permit flow of liquid beverage from said mixing container to said liquid tank; a return line arrangement being connected to said supply line arrangement to permit flow of liquid beverage not dispensed from said beverage container filling elements back to said mixing container; at least one measuring device for the quantitative and/or qualitative analysis of the liquid beverage; said at least one measuring device being disposed at said return line arrangement to permit measurement of liquid beverage flowing through said return line arrangement from said liquid tank; and said at least one measuring device is configured to measure at least one of: liquid beverage concentration, liquid beverage temperature, liquid beverage density, liquid beverage conductivity.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application." may possibly not be used or useable in any one or more embodiments of the application.

The sentence immediately above relates to patents, published patent applications and other documents either incorporated by reference or not incorporated by reference.

The following patents, patent applications or patent publications, are hereby incorporated by reference as if set forth in their entirety herein except for the exceptions indicated herein: U.S. Pat. No. 5,944,071, having the title "Two chamber filling tank," published on Aug. 31, 1999; DE 100 28 676 A1, having the following English translation "Method and device for filling bottles, cans and similar containers with a liquid product," published on Jun. 20, 2002; and DE 103 43 281 A1, having the following English translation "METHOD AND DEVICE FOR THE PRODUCTION AND BOTTLING OF LIQUIDS ENRICHED WITH OXYGEN," published on Apr. 21, 2005.

All of the patents, patent applications or patent publications, except for the exceptions indicated herein, which were cited in the International Search Report dated Jan. 26, 2009, and/or cited elsewhere are hereby incorporated by reference as if set forth in their entirety herein, as follows: EP 1 598 308 A, having the title "LIQUID FILLING METHOD AND LIQUID FILLING DEVICE," published on Nov. 23, 2003; DE 201 05 716 U1, having the following German title "Gefässfüllmaschine," published on May 29, 2002; and US 2007/113919 A1, having the title "INSTALLATION FOR PACKAGING A LIQUID PRODUCT IN RECEPTACLES," published on May 24, 2007.

All of the patents, patent applications or patent publications, except for the exceptions indicated herein, which were cited in the German Office Action dated Jul. 7, 2009, and/or cited elsewhere are hereby incorporated by reference as if set forth in their entirety herein, as follows: DE 24 35 011 C2, having the following German 797 title "EINRICHTUNG ZUM LUFTFREIEN FUELLEN UND VERSCHLIESSEN VON TRANSPORTBEHAELTERN FUER BIER, INSBESONDERE VON BIERFLASCHEN," published on Apr. 7, 1983; and DE 39 30 593 A1, having the following English translation "Carbon dioxide returned from bottle filling machine—is restored to useful concn. by controlled injection of pure gas into mixer," published on Mar. 14, 1991.

Some examples of bottling systems, which may be used or adapted for use in at least one possible embodiment of the present application may be found in the following U.S. Patents assigned to the Assignee herein, namely: U.S. Pat. Nos. 4,911,285; 4,944,830; 4,950,350; 4,976,803; 4,981,547; 5,004,518; 5,017,261; 5,062,917; 5,062,918; 5,075,123; 5,078,826; 5,087,317; 5,110,402; 5,129,984; 5,167,755; 5,174,851; 5,185,053; 5,217,538; 5,227,005; 5,413,153; 5,558,138; 5,634,500; 5,713,403; 6,276,113; 6,213,169; 6,189,578; 6,192,946; 6,374,575; 6,365,054; 6,619,016; 6,474,368; 6,494,238; 6,470,922; and 6,463,964.

Some examples of filling machines that utilize electronic control devices to control various portions of a filling or bottling process and that may possibly be utilized or possibly adapted for use in at least one possible embodiment of the present application may possibly be found in the following U.S. Pat. No. 4,821,921 issued to Cartwright et al. on Apr. 18, 1989; U.S. Pat. No. 5,056,511 issued to Ronge on Oct. 15, 1991; U.S. Pat. No. 5,273,082 issued to Paasche et al. on Dec. 28, 1993; and U.S. Pat. No. 5,301,488 issued to Ruhl et al. on Apr. 12, 1994.

Some examples of control systems which measure operating parameters and learn therefrom that may possibly be utilized or possibly adapted for use in at least one possible embodiment of the present application may possibly be found in the following U.S. Pat. No. 4,655,188 issued to Tomisawa et al. on Apr. 7, 1987; U.S. Pat. No. 5,191,272 issued to Torii et al. on Mar. 2, 1993; U.S. Pat. No. 5,223,820, issued to Sutterlin et al. on Jun. 29, 1993; and U.S. Pat. No. 5,770,934 issued to Theile on Jun. 23, 1998.

Some examples of closed-loop control circuits that may possibly be utilized or possibly adapted for use in at least one possible embodiment of the present application may possibly be found in the following U.S. Pat. No. 5,770,934 issued to Theile on Jun. 23, 1998; U.S. Pat. No. 5,189,605 issued to Zuehlke et al. on Feb. 23, 1993; U.S. Pat. No. 5,223,072 issued to Brockman et al. on Jun. 29, 1993; and U.S. Pat. No. 5,252,901, issued to inventors Ozawa et al. on. Oct. 12, 1993.

Some examples of heat exchangers which may possibly be utilized or adapted for use in at least one possible embodiment may possibly be found in the following U.S. Pat. No. 4,665,975, entitled "Plate type heat exchanger;" U.S. Pat. No. 6,810,948, entitled "Heat exchanger;" U.S. Pat. No. 6,799,428, entitled "Heat exchanger;" U.S. Pat. No. 6,394,179, entitled "Plate heat exchanger;" U.S. Pat. No. 6,125,649, entitled "Heat exchanger unit with conductive discs;" U.S. Pat. No. 5,579,650, entitled "Heat exchanger;" and U.S. Pat. No. 4,313,491, entitled "Coiled heat exchanger."

Some examples of computer systems that may possibly be utilized or possibly adapted for use in at least one possible embodiment of the present application may possibly be found in the following U.S. Pat. No. 5,416,480 issued to Roach et al. on May 16, 1995; U.S. Pat. No. 5,479,355 issued to Hyduke on Dec. 26, 1995; U.S. Pat. No. 5,481,730 issued to Brown et al. on Jan. 2, 1996; U.S. Pat. No. 5,805,094 issued to Roach et al. on Sep. 8, 1998; U.S. Pat. No. 5,881,227 issued to Atkinson et al. on Mar. 9, 1999; and U.S. Pat. No. 6,072,462 issued to Moshovich on Jun. 6, 2000.

Some examples of control valve apparatus that may possibly be utilized or possibly adapted for use in at least one possible embodiment of the present application may possibly be found in the following U.S. Pat. No. 5,406,975 issued to Nakamichi et al. on Apr. 18, 1995; U.S. Pat. No. 5,503,184 issued to Reinartz et al. on Apr. 2, 1996; U.S. Pat. No. 5,706,849 issued to Uchida et al. on Jan. 13, 1998; U.S. Pat. No. 5,975,115 issued to Schwegler et al. on Nov. 2, 1999; U.S. Pat. No. 6,142,445 issued to Kawaguchi et al. on Nov. 7, 2000; and U.S. Pat. No. 6,145,538 issued to Park on Nov. 14, 2000.

Some examples of electric control valves that may possibly be utilized or possibly adapted for use in at least one possible embodiment of the present application may possibly be found in the following U.S. Pat. No. 4,431,160 issued to Burt et al. on Feb. 14, 1984; and U.S. Pat. No. 4,609,176 issued to Powers on Sep. 2, 1986.

Some examples of electric valves which may possibly be utilized or adapted for use in at least one possible embodiment may possibly be found in the following U.S. Pat. No. 5,941,502, entitled "Electric valve assembly and method of making same;" U.S. Pat. No. 5,161,776, entitled "High speed electric valve;" U.S. Pat. No. 4,770,389, entitled "Electric valve device;" U.S. Pat. No. 4,699,167, entitled "Electric valve;" U.S. Pat. No. 4,681,298, entitled "Slidable electric valve device having a spring;" U.S. Pat. No. 4,580,761, entitled "Electric valve device having a rotatable core;" and U.S. Pat. No. 4,498,491, entitled "Thermo-electric valve."

Some examples of temperature sensors or sensor systems that may be used or adapted for use in at least one possible embodiment of the present invention may be found in the following U.S. Pat. No. 5,960,857, issued to inventors Oswalt et al. on Oct. 5, 1999; U.S. Pat. No. 5,942,980, issued to inventors Hoben et al. on Aug. 24, 1999; U.S. Pat. No. 5,881,952, issued to inventor MacIntyre on Mar. 16, 1999; U.S. Pat. No. 5,862,669, issued to inventors Davis et al. on Jan. 26, 1999; U.S. Pat. No. 5,459,890, issued to inventor Jarocki on Oct. 24, 1995; U.S. Pat. No. 5,367,602, issued to inventor Stewart on Nov. 22, 1994; U.S. Pat. No. 5,319,973, issued to inventors Crayton et al. on Jun. 14, 1994; U.S. Pat. No. 5,226,320, issued to inventors Dages et al. on Jul. 13, 1993; U.S. Pat. No. 5,078,123, issued to inventors Nagashima et al. on Jan. 7, 1992; and U.S. Pat. No. 5,068,030, issued to inventor Chen on Nov. 26, 1991.

Some examples of heaters or heat exchangers, cooling systems, valves, pumps, or tanks that may be used or adapted for use in at least one possible embodiment of the present invention may be found in the following U.S. Pat. No. 5,881,952, issued to inventor MacIntyre on Mar. 16, 1999; U.S. Pat. No. 5,862,669, issued to inventors Davis et al. on Jan. 26, 1999; U.S. Pat. No. 5,459,890, issued to inventor Jarocki on Oct. 24, 1995; U.S. Pat. No. 5,367,602, issued to inventor Stewart on Nov. 22, 1994; U.S. Pat. No. 5,319,973, issued to inventors Crayton et al. on Jun. 14, 1994; U.S. Pat. No. 5,226,320, issued to inventors Dages et al. on Jul. 13, 1993; U.S. Pat. No. 5,078,123, issued to inventors Nagashima et al. on Jan. 7, 1992; and U.S. Pat. No. 5,068,030, issued to inventor Chen on Nov. 26, 1991.

The patents, patent applications, and patent publications listed above in the preceding paragraphs are herein incorporated by reference as if set forth in their entirety except for the exceptions indicated herein. The purpose of incorporating U.S. patents, Foreign patents, publications, etc. is solely to provide additional information relating to technical features of one or more embodiments, which information may not be completely disclosed in the wording in the pages of this application. However, words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments of the patents, patent applications, and patent publications, are not considered to be incorporated by reference herein.

The corresponding foreign and international patent publication applications, namely, Federal Republic of Germany Patent Application No. 10 2007 058 047.0, filed on Nov. 30, 2007, having inventor Felix WAGNER, and DE-OS 10 2007 058 047.0 and DE-PS 10 2007 058 047.0, and International Application No. PCT/EP2008/008808, filed on Oct. 17, 2008, having WIPO Publication No. WO 2009/068144 A1 and inventor Felix WAGNER, are hereby incorporated by reference as if set forth in their entirety herein, except for the exceptions indicated herein, for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, except for the exceptions indicated herein, are hereby incorporated by reference as if set forth in their entirety herein.

The purpose of incorporating the corresponding foreign 945 equivalent patent applications, that is, PCT/EP2008/008808 and German Patent Application DE 10 2007 058 047.0, is solely for the purpose of providing a basis of correction of any wording in the pages of the present application, which may have been mistranslated or misinterpreted by the translator. However, words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned word in this sentence, when not used to describe technical features of one or more embodiments of the patents, patent applications, and patent publications, are not generally considered to be incorporated by reference herein.

Statements made in the original foreign patent applications PCT/EP2008/008808 and DE 10 2007 058 047.0 from which this patent application claims priority which do not have to do with the correction of the translation in this patent application are not to be included in this patent application in the incorporation by reference.

Any statements about admissions of prior art in the original foreign patent applications PCT EP2008/008808 and DE 10 2007 058 047.0 are not to be included in this patent application in the incorporation by reference, since the laws relating to prior art in non-U.S. Patent Offices and courts may be substantially different from the Patent Laws of the United States.

All of the references and documents cited in any of the documents cited herein, except for the exceptions indicated herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A method of filling containers, such as bottles, cans, or similar containers with carbonated liquid beverage, said method comprising the steps of:

circulating liquid beverage through a mixing container, a connecting line, a liquid tank, and a return line;

filling beverage containers with liquid beverage; and analyzing the liquid beverage flowing through said return line from said liquid tank with a measuring device in a qualitative manner by measuring at least one of: liquid beverage concentration, liquid beverage density, liquid beverage conductivity.

2. The method according to claim 1, wherein the liquid is monitored with regard to quality in terms of a closed loop, and the quality is monitored online.

3. A device for filling liquids, in particular carbonated beverages into bottles, cans or similar containers, said device having at least one filling tank and filler elements connected thereto, and having at least one measuring device for the quantitative analysis of the liquid, wherein the measuring device is positioned in a return line for the guiding of the liquid in a circulating manner through the filler tank, wherein the measuring device is in the form of a concentration and/or density and/or conductivity measuring device or the like.

4. The device according to claim 3, wherein the return line and a supply line to the respective filler element are connected to a common junction.

5. The device according to claim 4, wherein the return line opens out into a supply line of a mixing container that is connected upstream of the filler tank.

6. The device according to claim 5, wherein at least one heat exchanger is positioned in the return line.

7. The device according to claim 6, wherein a metering line opens out into the return line in order, in dependence on measured values of the measuring device, to adapt the liquid with regard to its quality to parameters transmitted by a control unit.

8. The device according to claim 7, wherein, with regard to qualitative parameters, the liquid is adjusted with the aid of the control unit, the measuring device and the metering line in terms of a closed loop.

9. A method of using the device according to claim 3 for filling liquids, such as carbonated beverages, in bottles , cans or similar containers, said device having at least one filler tank and filler elements connected thereto, wherein according to said method the liquid being analysed in a qualitative manner with the aid of a measuring device wherein the liquid is guided in a circulating manner through the filler tank and at the same time is analysed by means of the measuring device.

10. The method according to claim 9, wherein the liquid is monitored with regard to quality quantity in terms of a closed loop.

11. The method according to claim 10, wherein the quality is monitored online.

12. Device for filling liquids, in particular carbonated beverages into bottles, cans or similar containers, said device comprising:

at least one filling tank;

at least one filler element connected to each said filling tank;

a return line configured and disposed to circulate the liquid through said filling tank; and at least one measuring device configured and disposed to analyze at least one of concentration, density, and conductivity, in the liquid flowing in said return line.

13. Device according to claim 12 further comprising a supply line and a junction, said junction being in flow communication with said filling tank, said return line, and said supply line, said supply line being in flow communication with said filler element.

14. Device according to claim 12 further comprising a feed line and a mixing container, said feed line is configured and disposed to feed the liquid into said return line and said mixing container is configured and disposed to receive the liquid from said return line and said feed line and is in flow communication with said filling tank.

15. Device according to claim 12 further comprising at least one heat exchanger configured and disposed to the liquid in said return line.

16. Device according to claim 12 further comprising a metering line in flow communication with said return line and a control unit in electrical communication with said at least one measuring device, said metering line being controlled with said controlled unit and configured and disposed to adjust at least one parameter of the liquid.

17. Device according to claim 12 wherein said at least one filling tank, said at least one filler element, said return line , and said at least one measuring device are disposed in a closed loop.

18. Device according to claim 12 being configured and disposed for monitoring the liquid flowing in said return line online.

19. Device according to claim 12 being configured and disposed for monitoring $CO_2$ in the liquid flowing in said return line.

20. Device according to claim 16 wherein said metering line is configured and disposed to adjust $CO_2$ in the liquid flowing in said return line.

* * * * *